US006139184A

United States Patent [19]

Meldon et al.

[11] Patent Number: 6,139,184

[45] Date of Patent: Oct. 31, 2000

[54] SECURITY STORAGE CONTAINER

[76] Inventors: Ben Meldon, The Heather's Killough, Kicmacanogue, County Wicklow; Paul Saunders, Blackdown House, Kilteel, County Kildare, both of Ireland

[21] Appl. No.: 09/360,098

[22] Filed: Jul. 23, 1999

[51] Int. Cl.[7] ..... B65D 33/08

[52] U.S. Cl. ..... 383/10; 383/67; 383/84; 383/106; 229/70; 229/71

[58] Field of Search ..... 383/5, 10, 67, 383/84, 106; 229/300, 70, 74, 71

[56] References Cited

U.S. PATENT DOCUMENTS

| | | | |
|---|---|---|---|
| 378,849 | 2/1888 | Potter et al. | 229/70 |
| 709,805 | 9/1902 | Stearns et al. | 229/301 X |
| 791,362 | 5/1905 | Parmenter | 229/70 |
| 3,302,861 | 2/1967 | Hiersteiner | 229/74 X |
| 5,503,328 | 4/1996 | Roccaforte et al. | 229/301 |

FOREIGN PATENT DOCUMENTS

| | | | |
|---|---|---|---|
| 2 167 381 | 5/1986 | United Kingdom | 383/5 |
| 2 250 011 | 5/1986 | United Kingdom | 383/5 |
| 2 238 292 | 5/1991 | United Kingdom | 383/5 |

*Primary Examiner*—Jes F. Pascua

[57] ABSTRACT

A containment device is provided including a pair of flexible sheets each having a substantially rectangular configuration with a periphery having a top edge, a bottom edge and a pair of side edges. The top edges and the side edges of the sheets are coupled to define a sealable open bottom. The sheets are further coupled together along a line parallel with and adjacent to the top edge, wherein a cut out is formed in the sheets between with the top edges of the sheets and the line to define a handle.

8 Claims, 1 Drawing Sheet

SECURITY STORAGE CONTAINER

BACKGROUND OF THE INVENTION

1. Field of the Invention

The present invention relates to storage containers and more particularly pertains to a new security storage container for containing articles in a safe manner in a coat room or the like.

2. Description of the Prior Art

The use of storage containers is known in the prior art. More specifically, storage containers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,941,196; 5,476,323; 2,181,252; 3,933,304; 5,338,118; and U.S. Pat. No. Des. 280,043.

Where articles such as hand bags and other personal belongings are left in the care of, for example, cloakroom staff, there is always a problem of pilferage. This is particularly the case where articles are deposited for safe-keeping in cloakrooms of public places such as hotels, restaurants, concert halls, museums, art galleries and such other places of entertainment. Where, for example, a handbag, shopping bag or the like article is left with cloakroom staff, there is always the possibility that pilferage will occur, or what in many cases can be even more important, accusations of pilferage can arise which may be totally unjust and incorrectly based. Such accusations inevitably lead to claims for compensation against the owners of the establishment and of their very nature cause conflict between the owners and their staff operating such cloakrooms. There is thus a need to protect not just simply any depositor from pilferage, but also to protect staff from accusations of such pilferage. It is always easier for people to claim that they had something stolen and indeed they may often genuinely believe so than to actually admit to others or, indeed, more importantly to themselves that they might possibly have mislaid the item.

Even if pilferage does not occur, most people do not particularly want their belongings examined for the extraction of valuable information such addresses, car registration numbers and the like personal information. Nor indeed do many people want their more intimate possessions such as letters, diaries, etc. read by third parties. This, at its mildest is perceived to be an invasion of privacy and at its worst could indeed lead to subsequent loss of property due to theft, burglaries, etc. since knowing that somebody is attending a concert is a very good way of ascertaining a potential address for burglary.

It must also again be emphasised that there is a major problem for the venue owner and cloakroom operator who is trying to provide a service for his or her customers, by taking their possessions into safe-keeping while at the same time avoiding major litigation. Even if litigation does not occur, it is of no benefit whatsoever to a cloakroom operator to have accusations of theft leveled against the establishment since such an allegation automatically insures that there is now almost certainly as well as a dissatisfied customer an equally dissatisfied and disgruntled member or members of staff. No matter how an employer will assure a staff member that he or she is not under any cloud of suspicion, the mere fact of such an allegation being raised must of necessity cause distress and upset. The customer, even when he or she is confident that their possessions have not been tampered with, there is still always the nagging doubt that somebody has indeed rifled through one's possessions.

One particular area where these type of accusations, counter-accusations and general disquiet occurs is in many a workplace where there is an unsupervised cloakroom and employees leave possessions in the cloakroom, which possessions are not stolen, but may indeed be examined or otherwise rifled through by other members of staff. These, in some ways, are the most difficult situations to handle, since there has been no loss of property, but at the same time there is dissension among staff members.

In these respects, the security storage container according to the present invention substantially departs from the conventional concepts and designs of the prior art, and in so doing provides an apparatus primarily developed for the purpose of containing articles in a safe manner in a coat room or the like.

SUMMARY OF THE INVENTION

In view of the foregoing disadvantages inherent in the known types of storage containers now present in the prior art, the present invention provides a new security storage container construction wherein the same can be utilized for containing articles in a safe manner in a coat room or the like.

The general purpose of the present invention, which will be described subsequently in greater detail, is to provide a new security storage container apparatus and method which has many of the advantages of the storage containers mentioned heretofore and many novel features that result in a new security storage container which is not anticipated, rendered obvious, suggested, or even implied by any of the prior art storage containers, either alone or in any combination thereof.

To attain this, the present invention generally comprises a pair of inelastic transparent flexible sheets each having a substantially rectangular configuration. A periphery of the flexible sheets are equipped with a short top edge, a short bottom edge and a pair of elongated side edges. The sheets each have a common width and include a first sheet having a first length and a second sheet with a second length greater than the first length. The top edges and the side edges of the sheets are coupled to define an open bottom. As shown in the FIGURE, the bottom edge of the second sheet extends beyond that of the first sheet. The sheets are further coupled together along a line parallel with and adjacent to the top edge. Further, an elongated cut out is formed in the sheets between and in parallel with the top edges of the sheets and the line to define a handle. The first sheet further includes indicia situated thereon in the shape of a rectangle for allowing a verification signature to be written therein. Also included is an adhesive strip formed along the second sheet between the bottom edges of the first and second sheets. As such, the second sheet may be folded to adhere to the first sheet. A sealed compartment is thereby rendered for placing valuables therein. Finally, a protective piece is provided with a size similar to that of the adhesive strip. In use, the protective piece is adapted for being removably coupled to the adhesive strip.

Ideally the container is a bag of flexible material and preferably of, for example, a transparent plastics material. The advantage of a bag is that it is convenient for temporary storage of articles and the clear plastics material will allow the viewing of the articles within the bag.

In one embodiment of the invention the bag is an open-mouthed plastics bag and the closure is a strip of adhesive material adjacent the open mouth and covered with a backing sheet. Removal of the backing sheet will expose the adhesive which adhesive will prevent the re-opening without destroying its structural integrity. This will achieve in a very simple way the object of the invention in that once articles have been placed in the bag and the adhesive used to seal it they cannot be removed without immediately indicating that this has happened.

Ideally the bag has unique indicia printed thereon, sequential numbering being an obvious way of doing this. Once the bag has been identified and sealed, then if somebody else should remove the contents and then re-seal them in another bag, this will be immediately apparent.

Ideally the bag includes a carrying handle. This will be particularly advantageous for the obvious reasons.

In one preferred embodiment of the invention, each bag is numbered and provided with a corresponding numbered ticket for the depositor, which numbered ticket may be provided by a tear-off strap on the bag, a piece of material affixed to the bag by a non-permanent adhesive, such as, for example those used on stationery, often referred to as "notelets" and sold under the trade mark POST-IT.

It is also envisaged that on certain containers according to the invention a space may be provided to allow the depositor to sign his/her name on the bag, which signature can subsequently be compared to a new signature produced to allow the bag to be retrieved or can be used by the depositor when bags are left unattended in workplace cloakrooms.

In another way of carrying out the invention, instead of sealing a plastics bag or the like bag or container with an adhesive, there is provided a plastics bag and a heat sealing device which, once the bag has been sealed any tampering with it will be immediately apparent.

In a still further embodiment of the invention, there is provided a dispensing apparatus comprising:

a body member, for a plurality of container within the container;

a delivery device for dispensing one container at a time out of the body member; and a coin released mechanism to operate the delivery device.

Ideally the dispensing device includes heat sealing means, whereby it is possible to seal the bag, as these are particularly suitable after the contents have been placed therein. There are major advantages with such a dispensing device, since people can purchase the bag prior to coming to, for example, a cloakroom counter and can hand the bag and contents to the attendant, preferably removing a ticket which should ideally be placed in the bag from the bag, this allows quicker processing of the deposit of articles.

Further the invention provides a method of depositing articles for temporary storage comprising the steps of:

placing an article in the container;

sealing the container so that it can only be opened by destroying the structural integrity of the bag;

leaving the filled container for safekeeping;

retrieving the container out of safe-keeping; and checking the integrity of the container before opening and retrieving the contents.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new security storage container apparatus and method which has many of the advantages of the storage containers mentioned heretofore and many novel features that result in a new security storage container which is not anticipated, rendered obvious, suggested, or even implied by any of the prior art storage containers, either alone or in any combination thereof.

It is another object of the present invention to provide a new security storage container which may be easily and efficiently manufactured and marketed.

It is a further object of the present invention to provide a new security storage container which is of a durable and reliable construction.

An even further object of the present invention is to provide a new security storage container which is susceptible of a low cost of manufacture with regard to both materials and labor, and which accordingly is then susceptible of low prices of sale to the consuming public, thereby making such security storage container economically available to the buying public.

Still yet another object of the present invention is to provide a new security storage container which provides in the apparatuses and methods of the prior art some of the advantages thereof, while simultaneously overcoming some of the disadvantages normally associated therewith.

Still another object of the present invention is to provide a new security storage container for containing articles in a safe manner in a coat room or the like.

Even still another object of the present invention is to provide a new security storage container that includes a pair of flexible sheets each having a substantially rectangular configuration with a periphery having a top edge, a bottom edge and a pair of side edges. The top edges and the side edges of the sheets are coupled to define a sealable open bottom. The sheets are further coupled together along a line parallel with and adjacent to the top edge, wherein a cut out is formed in the sheets between with the top edges of the sheets and the line to define a handle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
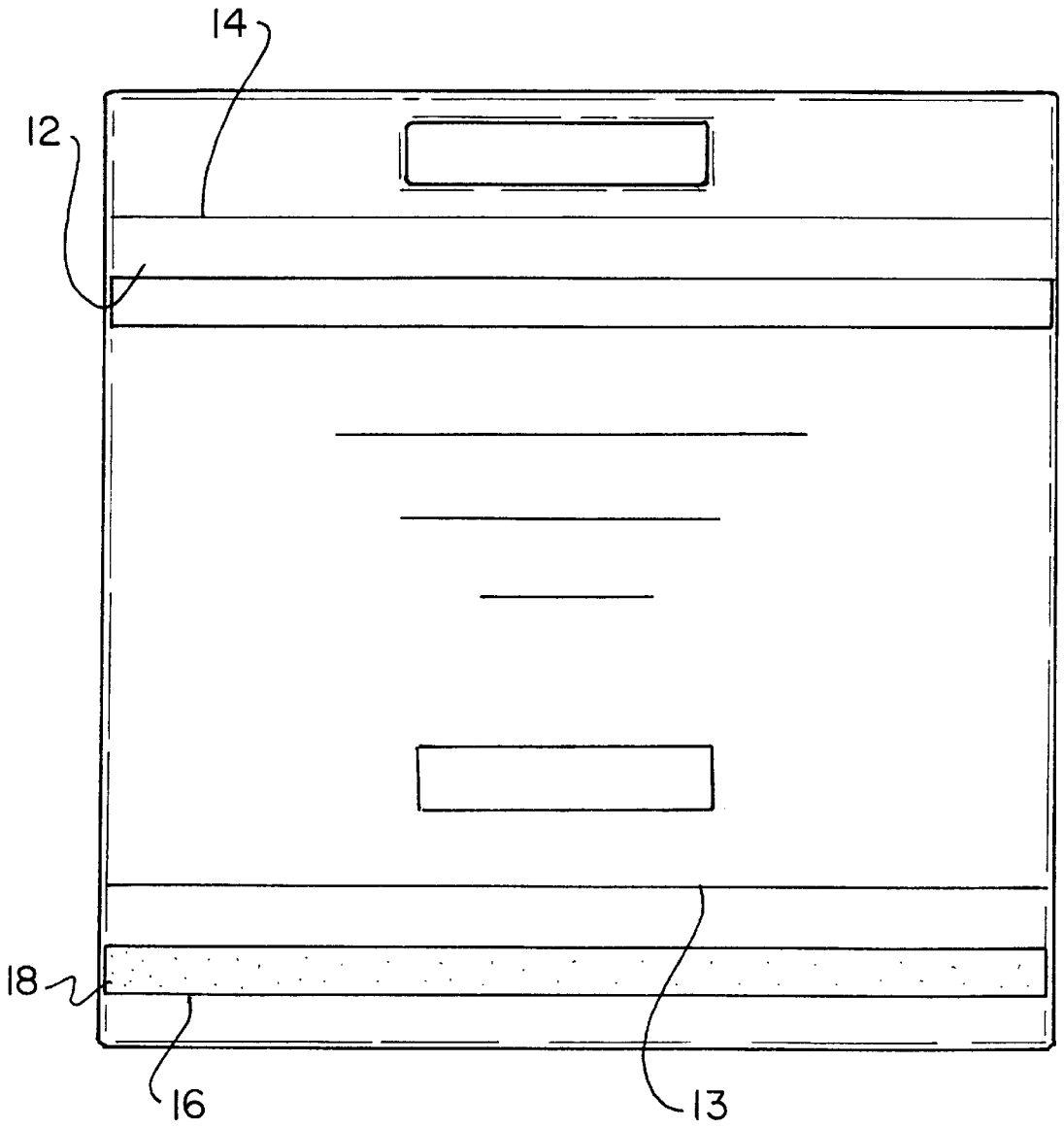
FIG. 1 is a top view of a new security storage container according to the present invention.

With reference now to the drawings, and in particular to FIG. 1 thereof, a new security storage container embodying the principles and concepts of the present invention and generally designated by the reference numeral 10 will be described.

The present invention, designated as numeral 10, includes a pair of inelastic transparent flexible sheets 12 each having a substantially rectangular configuration. Peripheries of the flexible sheets are equipped with a short top edge, a short bottom edge and a pair of elongated side edges. The sheets each have a common width and include a first sheet having a first length and a second sheet with a second length greater than the first length. The top edges and the side edges of the sheets are coupled to define an open bottom 13. As shown in the FIGURE, the bottom edge of the second sheet extends beyond that of the first sheet.

The sheets are further coupled together along a line 14 parallel with and adjacent to the top edge. Further, an elongated cut out is formed in the sheets between and in parallel with the top edges of the sheets and the line to define a handle. The first sheet further includes indicia situated thereon in the shape of a rectangle for allowing a verification signature to be written therein.

A signature panel and number panel are defined on a rear of the bag and a flap is foldable over the mouth of the bag, a free end of the flap being stuck by adhesive onto the rear of the bag over the signature/number panel so any tampering which opens the flap will destroy the signature giving tamper evidence.

Also included is an adhesive strip 16 formed along the second sheet between the bottom edges of the first and second sheets. As such, the second sheet may be folded to adhere to the first sheet. A sealed compartment is thereby rendered for placing valuables therein.

Finally, a protective piece 18 is provided with a size similar to that of the adhesive strip. During operation, the protective piece is adapted for being removably coupled to the adhesive strip.

In use, the aforementioned bag may be employed in a method of preventing the theft of articles in a storage room. It should be noted that the bag may be dispensed via a machine or the like for a predetermined fee. The method of the present invention includes the steps of: placing articles to be stored in the bag; placing an identification signature/number of an owner on the bag; sealing the bag; storing the bag; and returning the bag to the owner only upon the verification of the signature/number. Such verification preferably requires the owner to again write down his or her signature/number which is compared to that on the bag. The foregoing method thus prevents the loss and theft of stored items.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A method of preventing the theft of articles in a storage room, the method comprising the steps of:

providing a bag comprising a pair of inelastic flexible sheets, at least one of the sheets being transparent to permit viewing into an interior of the bag for identifying any articles in the interior of the bag;

placing articles to be stored in the bag;

placing an identification signature of a person on the bag;

storing the bag; and returning the bag to the person corresponding to the identification signature upon the verification of the signature.

2. The method of claim 1 wherein the providing step includes forming each of the flexible sheets with a substantially rectangular configuration with a periphery having a short top edge, a short bottom edge and a pair of elongated side edges, the sheets each having a common width and including a first sheet having a first length and a second sheet with a second length greater than the first length, the top edges and the side edges of the sheets being coupled to define an open bottom with the bottom edge of the second sheet extending beyond that of the first sheet, the sheets further being coupled together along a line parallel with and adjacent to the top edge.

3. The method of claim 1 wherein the providing step includes forming an elongated cut out in each of the sheets, the elongated cut out in each of the sheets extending substantially parallel to an edge of the sheet, the cut outs being substantially aligned with each other to form a handle in the bag.

4. The method of claim 1 wherein the providing step includes marking on one of the sheets an indicia adapted for permitting a verification signature to be written on the indicia.

5. The method of claim 1 wherein the sheets include first and second sheets, and wherein the providing step includes forming an adhesive strip on the second sheets between bottom edges of the first and second sheets such that the second sheet may be folded over onto the first sheet such that the adhesive strip adheres the second sheet to the first sheet for creating a sealed compartment for placing valuables therein.

6. The method of claim 5 additionally comprising providing a protective piece with a size similar to that of the adhesive strip, the protective piece being removably adhesively coupled to the adhesive strip.

7. The method of claim 1 wherein the providing step includes forming each of the flexible sheets with a substantially rectangular configuration with a periphery having a short top edge, a short bottom edge and a pair of elongated side edges, the sheets each having a common width and including a first sheet having a first length and a second sheet with a second length greater than the first length, the top edges and the side edges of the sheets being coupled to define an open bottom with the bottom edge of the second sheet extending beyond that of the first sheet, the sheets further being coupled together along a line parallel with and adjacent to the top edge;

wherein the providing step includes forming an elongated cut out in each of the sheets, the elongated cut out in each of the sheets extending substantially parallel to an edge of the sheet, the cut outs being substantially aligned with each other to form a handle in the bag;

wherein the providing step includes marking on one of the sheets an indicia adapted for permitting a verification signature to be written on the indicia;

wherein the sheets include first and second sheets, and wherein the providing step includes forming an adhesive strip on the second sheets between bottom edges of the first and second sheets such that the second sheet may be folded over onto the first sheet such that the adhesive strip adheres the second sheet to the first sheet for creating a sealed compartment for placing valuables therein; and additionally comprising the step of providing a protective piece with a size similar to that of the adhesive strip, the protective piece being removably adhesively coupled to the adhesive strip.

8. The method of claim 1 additionally comprising the step of destroying the identification signature by opening the bag to retrieve the articles from the bag such that the owner may determine if the bag has previously opened.

* * * * *